US010953417B2

(12) United States Patent
Halamandaris et al.

(10) Patent No.: US 10,953,417 B2
(45) Date of Patent: Mar. 23, 2021

(54) ADJUSTABLE CANTILEVERED PAINT ACTUATION SYSTEM

(71) Applicant: The Boeing Company, Chicago, IL (US)

(72) Inventors: George P. Halamandaris, Moorpark, CA (US); John E. Miller, Ladson, SC (US); Shane E. Arthur, Kirkland, WA (US); Raymond C. Eng, Burien, WA (US); Matthew H. Mellin, Charleston, SC (US); Bennett M. Moriarty, Seattle, WA (US); Kyle S. Biondich, Seattle, WA (US)

(73) Assignee: The Boeing Company, Chicago, IL (US)

( * ) Notice: Subject to any disclaimer, the term of this patent is extended or adjusted under 35 U.S.C. 154(b) by 74 days.

(21) Appl. No.: 16/544,310

(22) Filed: Aug. 19, 2019

(65) Prior Publication Data

US 2019/0366360 A1 Dec. 5, 2019

Related U.S. Application Data

(62) Division of application No. 15/414,154, filed on Jan. 24, 2017, now Pat. No. 10,384,217.

(51) Int. Cl.
*B05B 3/12* (2006.01)
*B05B 3/02* (2006.01)
(Continued)

(52) U.S. Cl.
CPC ..... *B05B 3/12* (2013.01); *B05B 1/14* (2013.01); *B05B 3/025* (2013.01); *B05B 12/124* (2013.01);
(Continued)

(58) Field of Classification Search
CPC ..... B05D 5/00; B05D 2254/02; B41J 3/4073
See application file for complete search history.

(56) References Cited

U.S. PATENT DOCUMENTS

2001/0005942 A1* 7/2001 Patton ..... B41J 2/01 33/18.1
2007/0062383 A1 3/2007 Gazeau et al.
(Continued)

OTHER PUBLICATIONS

Office Action for related Chinese Application No. 201711345403.X; report dated Oct. 10, 2020.

*Primary Examiner* — Nathan T Leong
(74) *Attorney, Agent, or Firm* — von Briesen & Roper, s.c.

(57) ABSTRACT

A surface treatment assembly for treating a contoured surface includes a surface treatment array formed from a plurality of base structures, each base structure operably coupled to a first phalange structure and a first phalange structure first end. A second phalange structure operatively coupled to each first phalange structure and a phalange joint disposed between each first phalange structure and each second phalange, thereby forming a finger structure. Moreover, at least one applicator head is coupled to a second phalange structure second end of each finger structure and configured to treat the contoured surface. A base structure actuator and a phalange joint actuator operatively coupled to and configured to manipulate the first phalange structure and the second phalange of each finger structure to adjust the surface treatment array relative to the contoured surface.

20 Claims, 6 Drawing Sheets

(51) Int. Cl.

| | |
|---|---|
| ***B05B 1/14*** | (2006.01) |
| ***B05B 15/68*** | (2018.01) |
| ***B05B 12/12*** | (2006.01) |
| ***B05B 13/04*** | (2006.01) |
| ***B41J 3/407*** | (2006.01) |
| ***B05D 5/00*** | (2006.01) |
| *B05B 7/08* | (2006.01) |

(52) U.S. Cl.
CPC ..... *B05B 13/0436* (2013.01); *B05B 15/68* (2018.02); *B05D 5/00* (2013.01); *B41J 3/4073* (2013.01); *B05B 7/0892* (2013.01); *B05B 13/0431* (2013.01); *B05D 2254/02* (2013.01)

(56) References Cited

U.S. PATENT DOCUMENTS

| | | | | |
|---|---|---|---|---|
| 2009/0257070 | A1* | 10/2009 | Baird | B41J 25/308 358/1.5 |
| 2018/0056670 | A1 | 3/2018 | Kerr et al. | |
| 2018/0071773 | A1* | 3/2018 | Eng | B05B 12/04 |
| 2018/0099518 | A1 | 4/2018 | Eng et al. | |

* cited by examiner

ADJUSTABLE CANTILEVERED PAINT ACTUATION SYSTEM

FIELD

The present disclosure relates generally to automated surface treatment assemblies and methods for treating a surface, and more specifically to an automated adjustable surface treatment assembly system and method for treating a contoured surface.

BACKGROUND

Treating and coating structural surfaces of machines, such as commercial aircraft, is a long and extensive process. Surface treatment often requires coating a structural surface that includes a variety of large contoured surfaces. Furthermore, coating the structural surfaces includes applying multiple layers of coatings for engineering properties, as well as to apply a decorative livery. The decorative livery is applied using a complex process which requires a series of masking operations followed by applying colored paints or coatings where they are needed. These masking and painting operations are serially repeated until the exterior surface treatment is completed. Performing these processes on large areas with a variety of contoured surfaces, therefore, requires a significant amount of time and resources.

SUMMARY

In accordance with one aspect of the present disclosure a surface treatment assembly for treating a contoured surface is disclosed. The surface treatment assembly includes a surface treatment array formed from a plurality of base structures and each base structure being operably coupled to a first phalange structure and a first phalange structure first end. The surface treatment assembly may further include a second phalange structure operatively coupled to each first phalange structure and a phalange joint disposed between each first phalange structure and each second phalange structure. The phalange joint is operably coupled to a first phalange structure second end and a second phalange structure first end, thereby forming a finger structure. Moreover, at least one applicator head is coupled to a second phalange structure second end of each finger structure and each of the at least one applicator head being configured to treat the contoured surface. The surface treatment assembly further includes a base structure actuator operatively coupled to and configured to manipulate the first phalange structure of each finger structure. Furthermore, a phalange joint actuator is operatively coupled to and configured to manipulate the second phalange structure of each finger structure. The base structure actuator and the phalange joint actuator being configured to adjust the surface treatment array relative to the contoured surface.

In accordance with another aspect of the present disclosure, a method of treating a contoured surface with a surface treatment assembly is disclosed. The method includes forming a surface treatment array from a plurality of base structures and coupling a finger structure to each base structure of the plurality of base structures. The finger structure including a first phalange structure, a second phalange structure and a phalange joint disposed therebetween. The method further includes coupling at least one applicator head to the second phalange structure of each finger structure, and each of the at least one applicator head being configured to apply a surface treatment layer to the contoured surface. The method further includes, coupling a base structure actuator to each base structure and a phalange joint actuator to each phalange joint, and manipulating each of the base structure actuators and each of the phalange joint actuators such that the surface treatment array is adjusted relative to the contoured surface.

In accordance with yet another aspect of the present disclosure, a surface treatment system for treating an exterior surface of an airplane is disclosed. The surface treatment system includes a circular surface treatment array formed from a plurality of base structures, each base structure being operably coupled to a first phalange structure at a first phalange structure first end. The surface treatment system may further include a second phalange structure operatively coupled to each first phalange structure and a phalange joint disposed between each first phalange structure and each second phalange structure. The phalange joint is operably coupled to a first phalange structure second end and a second phalange structure first end, thereby forming a finger structure. Moreover, at least one applicator head is coupled to a second phalange structure second end of each finger structure and each of the at least one applicator head being configured to treat a contoured surface along the exterior surface of the airplane. The surface treatment assembly further includes a base structure actuator operatively coupled to and configured to manipulate the first phalange structure of each finger structure. Furthermore, a phalange joint actuator is operatively coupled to and configured to manipulate the second phalange structure of each finger structure. At least one sensor is coupled to each finger structure of the circular surface treatment array and the at least one sensor being configured to detect an existing shape of the contoured surface and generate a contoured data set. The surface treatment system further includes a controller communicably coupled to the at least one sensor, the base structure actuator, and the phalange joint actuator. The controller being programmed to receive a signal from the at least one sensor and to control the base structure actuator and the phalange joint actuator to manipulate the circular surface treatment array based on the contoured data set of the exterior surface of the airplane.

The features, functions, and advantages disclosed herein can be achieved independently in various embodiments or may be combined in yet other embodiments, the details of which may be better appreciated with reference to the following description and drawings.

It should be understood that the drawings are not necessarily to scale, and that the disclosed embodiments are illustrated diagrammatically, schematically, and in some cases in partial views. In certain instances, details which are not necessary for an understanding of the disclosed methods and apparatuses or which render other details difficult to perceive may have been omitted. It should be further understood that the following detailed description is merely exemplary and not intended to be limiting in its application or uses. As such, although the present disclosure is for purposes of explanatory convenience only depicted and described in illustrative embodiments, the disclosure may be implemented in numerous other embodiments, and within various systems and environments not shown or described herein.

DETAILED DESCRIPTION

The following detailed description is intended to provide both methods and devices for carrying out the disclosure. Actual scope of the disclosure is as defined by the appended claims.

Figure 1:
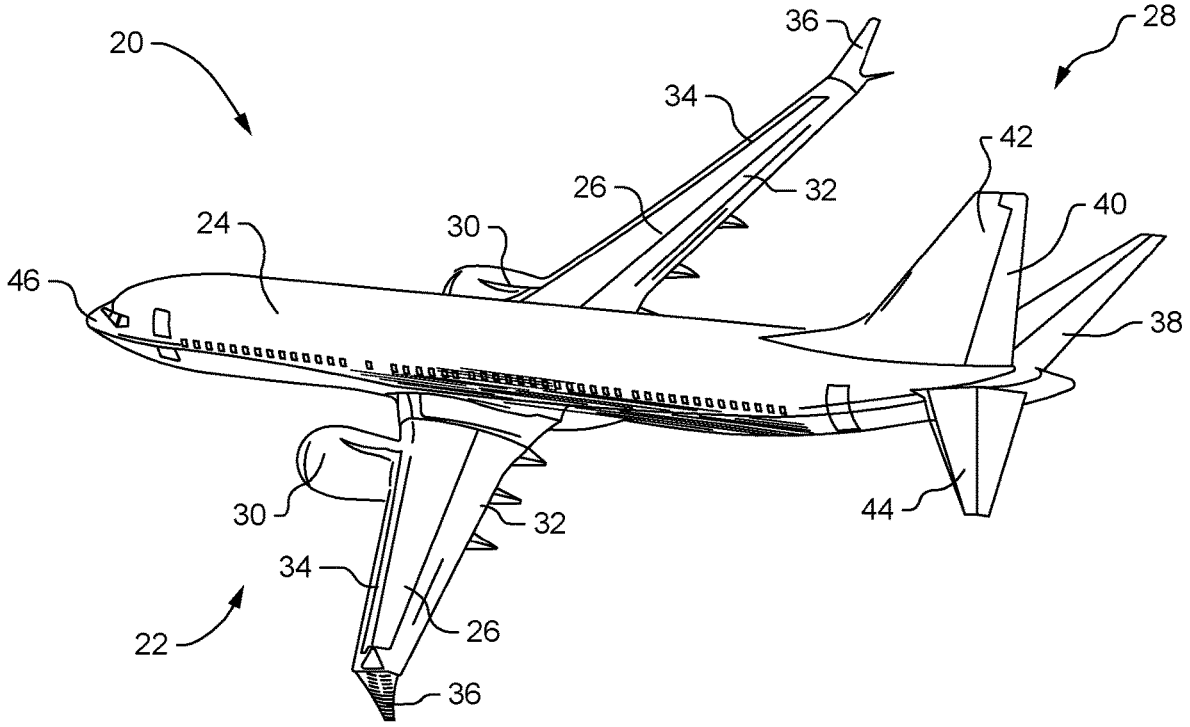
FIG. 1 is a perspective view of an exemplary vehicle constructed in accordance with the present disclosure.

Referring to FIG. 1, a vehicle 20 is illustrated. One non-limiting example of the vehicle 20 is that of an aircraft; however the present disclosure applies to other types of vehicles and machines as well. As illustrated, the vehicle 20 is configured with an airframe 22 which includes a fuselage 24, wings 26, and a tail section 28. Additionally, one or more propulsion units 30 are coupled to each wing 26 in order to propel the vehicle 20 in a direction of travel. Furthermore, each wing 26 is fixedly attached to the fuselage 24 and the propulsion units 30 are attached to an underside surface of the wing 26, however other attachment locations of the propulsion units 30 are possible. In some embodiments, each wing 26 is positioned at a substantially centered position along the fuselage 24, and each wing 26 is configured to include a plurality of flaps 32, leading edge devices 34, and peripheral edge devices 36 (i.e., winglets). Moreover, during operation of the vehicle 20, the flaps 32, leading edge devices 34 and peripheral edge devices 36 are capable of being adjusted in a plurality of positions in order to control and stabilize the vehicle 20. For example, the flaps 32 and leading edge devices 34 are adjustable in several different positions to produce the desired lift characteristics of the wings 26. Additionally, the tail section 28 of the airframe 22 includes components which provide other stability and maneuverability functions of the vehicle 20, such as an elevator 38, a rudder 40, a vertical stabilizer fin 42, and a horizontal stabilizer 44.

Figure 2:
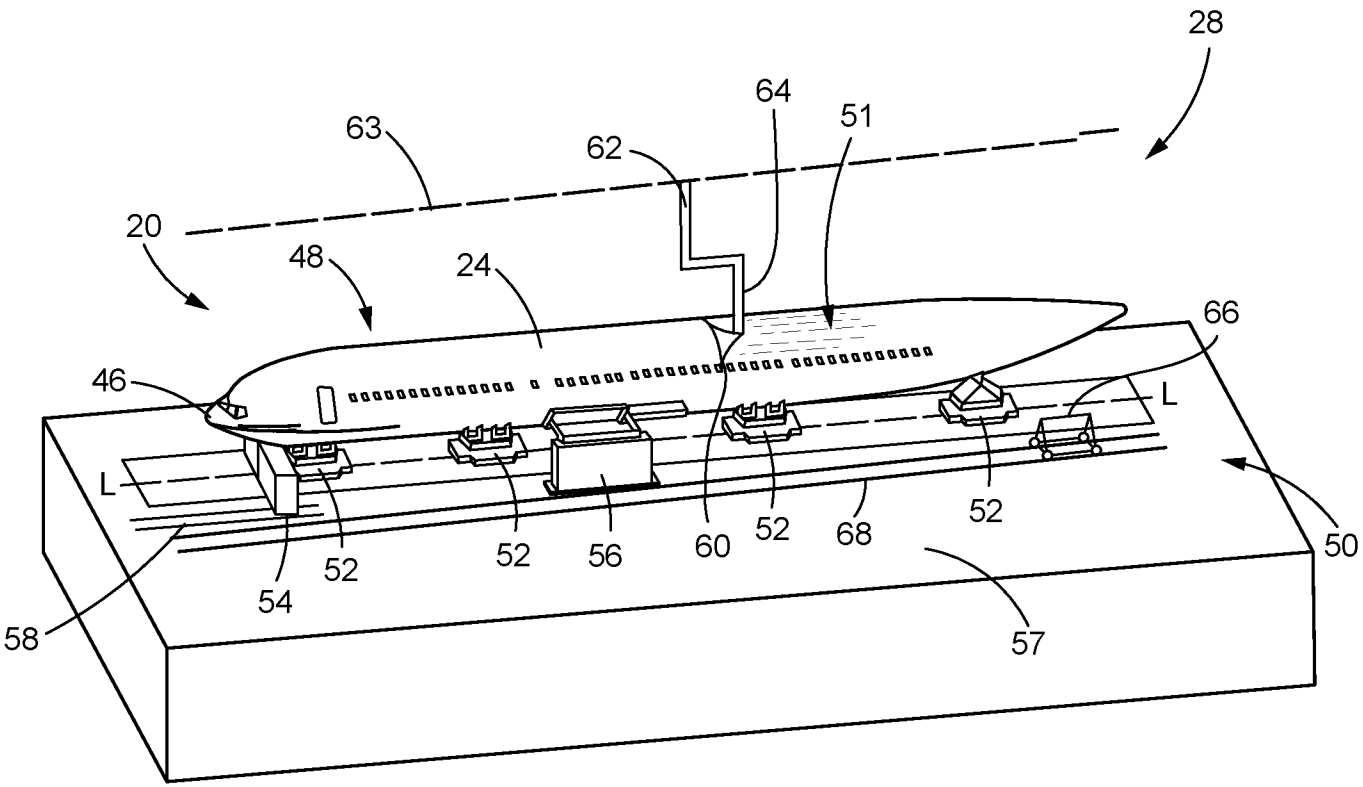
FIG. 2 is a perspective view of an exemplary contoured surface and surface treatment assembly positioned in a work area, in accordance with the present disclosure.

FIG. 2 illustrates one non-limiting example of the fuselage 24 portion of the vehicle 20, with the wings 26, rudder 40, vertical stabilizer fin 42 horizontal stabilizer 44, and other components unattached or removed from the fuselage 24. Generally, the fuselage 24 and other components of the vehicle 20 are constructed out of aluminum, aluminum alloy, titanium, carbon composite, or other known material. Moreover, the fuselage 24 forms a tubular structure of the vehicle 20, which includes a nose portion 46 designated as the front of the fuselage 24 and the tail section 28 designated as the rear of the fuselage 24. The outer surface of the fuselage 24 has changing dimensions and topography along the length of the fuselage 24 between the nose portion 46 and the tail section 28. As a result, the fuselage 24 is often described as having a contoured surface 48 or profile. In one embodiment, the contoured surface 48 includes a variety of surface profiles formed by a series of changing surface geometries of the fuselage 24 and other vehicle 20 components. For example, moving along the fuselage 24 from the nose portion 46 to the tail section 28, the contoured surface 48 exhibits changing geometries and profiles such as but not limited to, an increase in diameter of the fuselage 24, a decrease in diameter of the fuselage 24, a convex surface, a concave surface, or other such surface geometries, and profiles, or combinations thereof.

During vehicle 20 manufacture and/or servicing, the fuselage 24, and other vehicle components, is positioned within a work area 50 and prepared for one or more manufacturing and/or scheduled service steps. In some embodiments, the manufacturing and/or servicing of the vehicle 20 includes applying a surface treatment layer 51 along the contoured surface 48 of the fuselage 24. Generally, the application of the surface treatment layer 51 along the contoured surface 48 includes one or more of cleaning, abrading, priming, painting, protecting, curing, inspecting, repairing, or other known surface treatments of the contoured surface 48. Moreover, one non-limiting example of the surface treatment layer 51 includes the application of decorative livery coatings, which not only provide surface protection against the harsh environmental conditions encountered by the vehicle 20, but also create a decorative design on the fuselage 24 which helps to identify and distinguish the one vehicle 20 from another. Additionally, in some embodiments, the surface treatment layer 51 is composed of multiple layers such as, primer coatings, adhesion promoters, base coats, clear coats, livery coats, and other surface treatment layers are applied to the contoured surface 48.

As further illustrated in FIG. 2, the vehicle 20 is prepared for surface treatments by positioning the fuselage 24 within the work area 50 prior to attaching, or otherwise coupling, each wing 26 (FIG. 1), rudder 40 (FIG. 1), vertical stabilizer fin 42 (FIG. 1), horizontal stabilizer 44 (FIG. 1), and other components to the vehicle 20. However, in alternative embodiments, such as but not limited to, during service or maintenance of the vehicle 20, surface treatment of the contoured surface 48 is possible on a fully assembled vehicle 20 with the wings 26 (FIG. 1), rudder 40 (FIG. 1), vertical stabilizer fin 42 (FIG. 1), horizontal stabilizer 44 (FIG. 1) and other components already attached. For example, in some instances, the exterior surface of the vehicle 20 is damaged during operation and the contoured surface 48 requires repair to fix the damage. As a result, the fully assembled vehicle 20 is positioned within the work area 50 and prepared for one or more surface treatments.

Prior to the start of the surface treatment, the fuselage 24 is delivered to the work area 50 by a plurality of automated guided vehicles 52 (AGVs). The AGVs 52 are positioned along the underside of the fuselage 24 to provide adequate support to the vehicle 20 and configured to move the fuselage 24 into position. While FIG. 2 shows the use of four AGVs 52, other numbers of AGVs 52 (i.e., fewer or greater) are certainly possible. Once the AGVs 52 move the fuselage 24 into the work area 50 one or more structures are positioned along the underside of the fuselage 24 to provide support during the surface treatment. In some embodiments, a vehicle nose support structure 54 is located on the underside of the nose portion 46 of the fuselage 24 and at least one vehicle central support structure 56 is positioned underneath of the central portion of the fuselage 24. Additionally, while the vehicle nose support structure 54 and the vehicle central support structure 56 are shown in FIG. 2, one or more additional support structures can be placed in other places along the fuselage 24 which require support, such as but not limited to, underneath the tail section 28 or anywhere in between the vehicle nose support structure 54 and vehicle central support structure 56.

In one non-limiting embodiment, the nose and vehicle central support structures 54, 56 are slidably coupled to the floor 57 of the work area 50 by a set of vehicle support structure rails 58. The nose and vehicle central support structures 54, 56 each slide along the vehicle support structure rails 58 and are positioned underneath the fuselage 24 to ensure the fuselage 24, or other component of the vehicle 20, is properly supported. Furthermore, the nose and vehicle central support structures 54, 56 are configured such that they are able to move along the vehicle support structure rails 58 without interfering with the AGVs 52. As a result, the AGVs 52 are capable of being used along with the nose and vehicle central support structures 54, 56 to support the fuselage 24, or other component of the vehicle 20, during surface treatment. While FIG. 2 illustrates the use of AGVs 52 and the nose and vehicle central support structures 54, 56 to transport and support the fuselage 24 and other components of the vehicle 20, it will be known to those skilled in the art that other methods of positioning, supporting and transporting the fuselage 24 and other vehicle 20 components are possible.

As further illustrated in FIG. 2, the work area 50 is equipped with at least one surface treatment assembly 60 that is configured to apply or otherwise treat the contoured surface 48 of the vehicle 20 with a surface treatment layer 51. In some embodiments, the surface treatment assembly 60 is attached to an overhead gantry 62, which is configured to provide support and movement of the surface treatment assembly 60 within the work area 50. In one non-limiting example, the overhead gantry 62 is attached to an overhead gantry structure 63 that runs the length L-L of the work area 50 that houses the fuselage 24 or other components of the vehicle 20 during surface treatment. The overhead gantry 62 is configured to move the surface treatment assembly 60 along the overhead gantry structure 63 as it treats the contoured surface 48 of the vehicle 20. Furthermore, in one non-limiting example the surface treatment assembly 60 includes an attachment pillar 64 which couples the surface treatment assembly 60 to the overhead gantry 62.

Additionally or alternatively, the surface treatment assembly 60 is mounted on a surface treatment assembly automated guided vehicle (AGV) 66, similar to the AGVs 52 used to move the fuselage 24 in and out of the work area 50. The surface treatment assembly AGV 66 is configured to move along the length L-L of the floor 57 of the work area 50 as the surface treatment assembly 60 treats the contoured surface 48 of the vehicle 20. In one embodiment, the surface treatment assembly AGV 66 is coupled to a set of surface treatment AGV rails 68, which are positioned laterally alongside the fuselage 24 and configured to run along the length L-L of the floor 57 of the work area 50. Furthermore, some embodiments include two sets of the surface treatment AGV rails 68 that are spaced apart within the work area 50 such that the fuselage 24 is capable of being positioned and substantially centered between the two sets of the surface treatment AGV rails 68. As a result, one or more surface treatment assemblies 60 are capable of being positioned on each side of the fuselage 24 during surface treatment of the contoured surface 48. In an alternative embodiment, the surface treatment assembly AGV 66 is configured with a set of wheels or other ground engaging elements that do not require being mounted on the surface treatment AGV rails 68. As a result, the surface treatment assembly AGV 66 travels along the floor 57 of the work area 50 on the set of wheels or other ground engaging elements while the surface treatment assembly 60 treats the contoured surface 48 of the vehicle 20.

In some embodiments, a plurality of surface treatment assemblies 60 are used for surface treatment of the contoured surface 48 such that one or more surface treatment assemblies 60 are mounted on one or more overhead gantries 62, one or more surface treatment support assembly AGVs 66 or a combination thereof. The overhead gantry 62 and/or the surface treatment assembly AGV 66 are arranged around the fuselage 24 to position each of the surface treatment assemblies 60 adjacent to the contoured surface 48. As a result, the plurality of surface treatment assemblies 60 mounted on the overhead gantry 62 and/or surface treatment support assembly AGVs 66 are arranged to circumferentially surround the tubular fuselage 24, or other such surface geometry of the fuselage 24. As a result, the surface treatment layer 51, or other such surface treatment is applied to the entire circumference of the contoured surface 48 as the plurality of surface treatment assemblies move along the fuselage 24.

Figure 3:
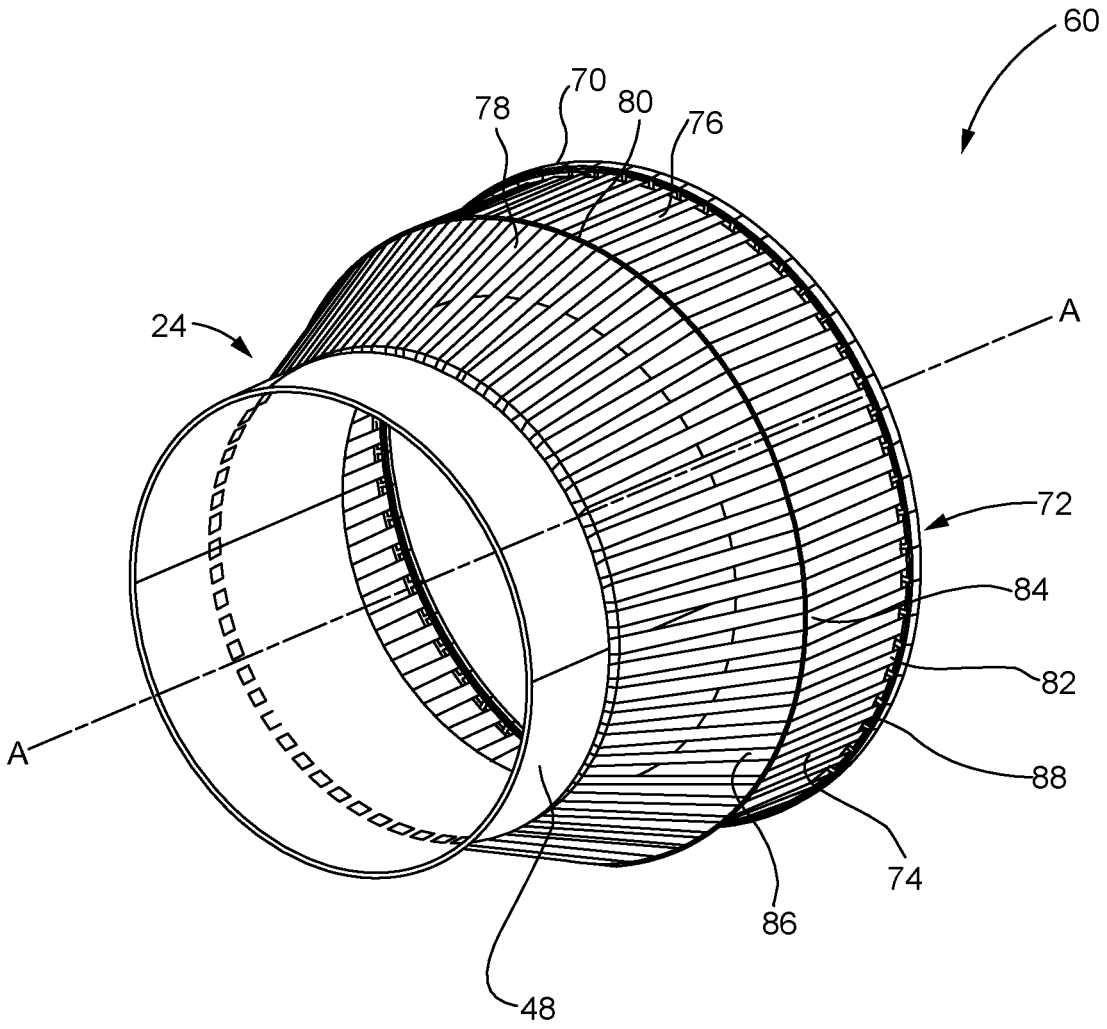
FIG. 3 is a perspective view of an exemplary surface treatment assembly, in accordance with the present disclosure.
Figure 4:
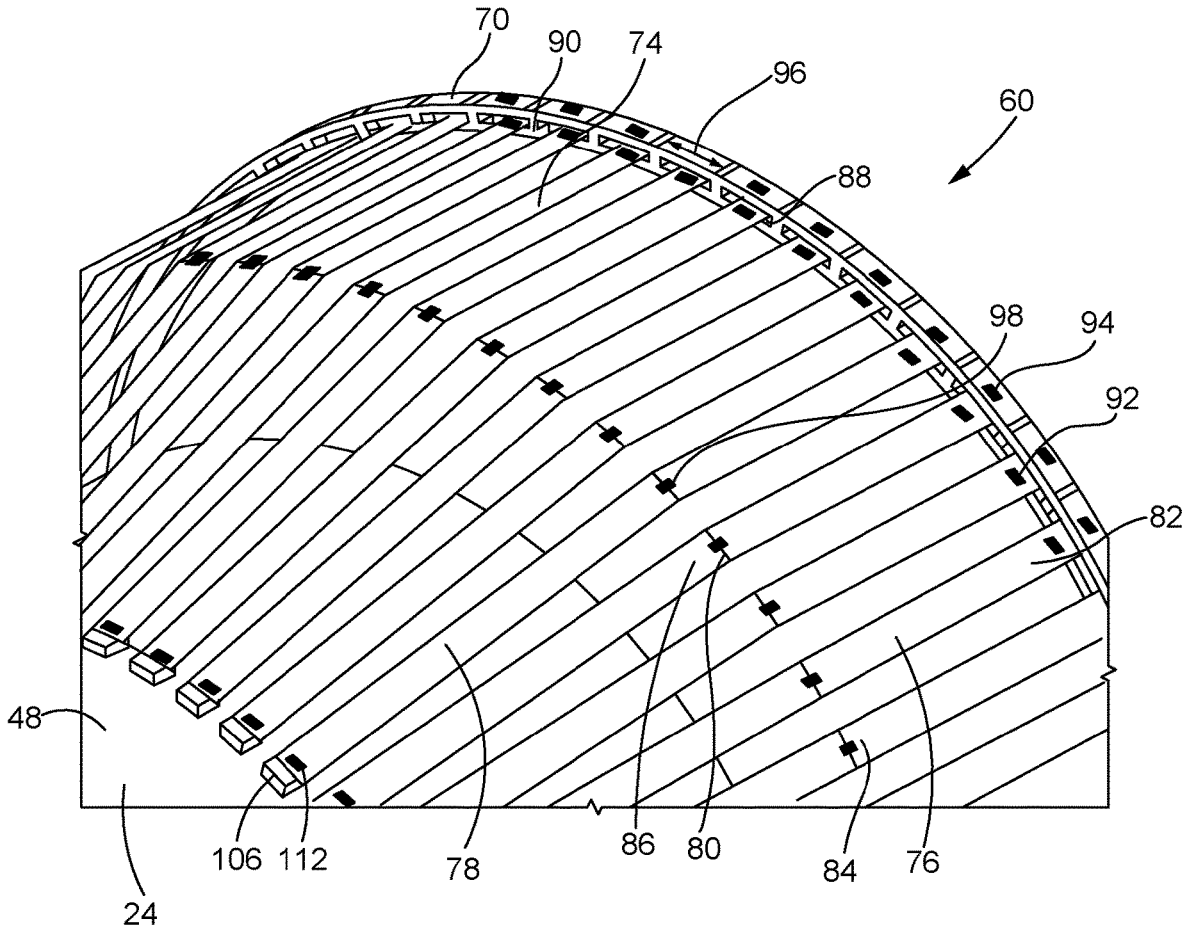
FIG. 4 is an enlarged perspective view of the surface treatment assembly of FIG. 3, in accordance with the present disclosure.

Referring now to FIGS. 3-4, one non-limiting embodiment of the surface treatment assembly 60 illustrated. In one non-limiting example, the surface treatment assembly 60 includes a plurality of base structures 70 arranged to form a circular array 72. As shown in FIG. 3, an embodiment of the surface treatment assembly 60 is arranged in a complete circular ring configured to circumferentially surround fuselage 24. Moreover, the circular array 72 is configured to have a larger diameter than the fuselage 24 such that the circular array 72 of the surface treatment assembly 60 is able to avoid contact with the fuselage 24 and any other components that are attached to the surface as the surface treatment assembly moves along the contoured surface 48. However, it will be understood that alternative or additional configurations of the plurality of base structure 70 are possible, such as but not limited to semi-circular, linear, staggered, or other such configuration to produce alternative geometries of the surface treatment assembly 60.

Additionally, the surface treatment assembly 60 includes a plurality of finger structures 74 which are operably coupled to the plurality of base structures 70. In some embodiments, the finger structures 74 are configured to extend away in the axial direction from the plurality of base structures 70 along an axis A-A. In one non-limiting example, the finger structures 74 are configured to include a first phalange structure 76 and a second phalange structure 78 operably coupled to one another at a phalange joint 80. As a result, manipulation of the finger structure 74 causes movement of the first phalange structure 76 and second phalange structure 78 about the phalange joint 80 to adduct (i.e., extend or move away from) and abduct (i.e., bend or move towards), or other such movement of each finger structure relative to the axis A-A. Moreover, in some embodiments, the first phalange structure 76 and the second phalange structure 78 are constructed out of a flexible material such as but not limited to, a composite, carbon fiber, flexible metal, or other known flexible material. Furthermore, each finger structure 74 is configured such that a first end 82 of the first phalange structure 76 is operably coupled to a base structure 70, and the phalange joint 80 is disposed between a second end 84 of the first phalange structure 76 and a first end 86 of the second phalange structure 78. As a result, the phalange joint 80 operatively couples the first phalange structure 76 to the second phalange structure 78 such that each finger structure 74 can be manipulated, adjusted or otherwise articulated in response to the topography or other surface geometry of the contoured surface 48.

Figure 5:
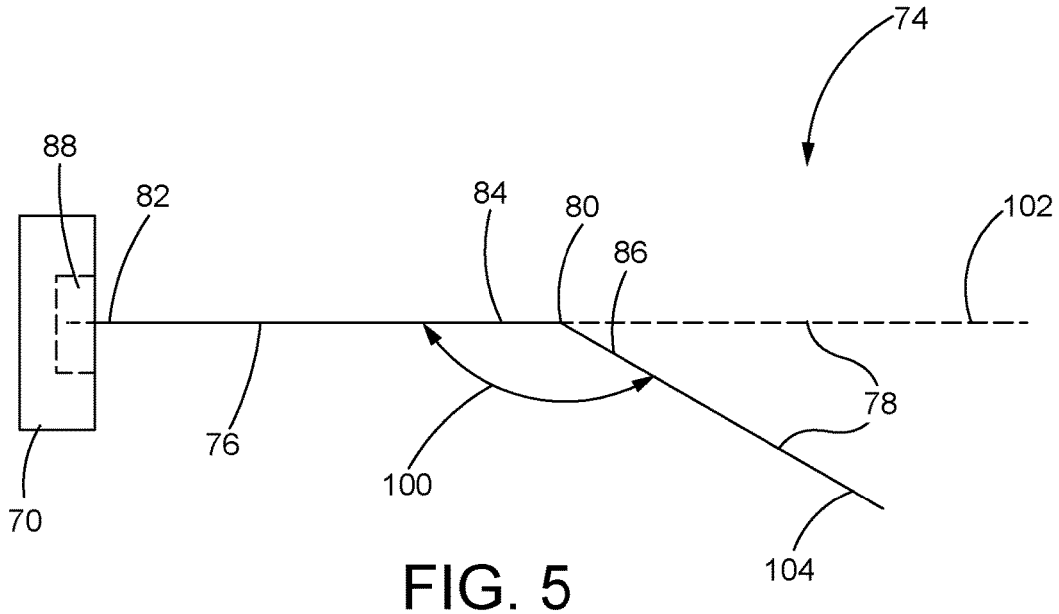
FIG. 5 is a schematic view of an exemplary finger structure of the surface treatment assembly of FIGS. 3 and 4, in accordance with the present disclosure.

As further illustrated in FIGS. 3 and 4, each base structure 70 is configured with a slot 88 that is formed into at least a portion of a base structure lateral surface 90. Moreover, at least a portion of the first end 82 of the first phalange structure 76 of each finger structure 74 is configured to extend into the slot 88. Additionally, in some embodiments, the first end 82 of the first phalange structure 76 is operably coupled to the base structure 70 with a base structure rotatable joint 92, such as but not limited to a ball joint. Moreover, each base structure 70 of the surface treatment assembly 60 includes a base structure actuating device 94, such as but not limited to a linear actuator, a radial actuator, or other known actuating device. The base structure actuating device 94 operably couples the first phalange structure 76 to the base structure 70 and the base structure actuating device 94 is configured to pivot or otherwise actuate the first end 82 of the first phalange structure 76 about the base structure rotatable joint 92 and within the slot 88. For example, the arrow 96 shown in FIG. 4 illustrates one non-limiting example of the lateral adjustment capability of the first phalange structure 76 within the slot 88 as the first end 82 of the first phalange structure 76 pivots or otherwise rotates about the base structure rotatable joint 92. In some embodiments, each finger structure 74 is configured with a phalange joint actuator 98, such as but not limited to, a hinge actuator or other such actuating device. The phalange joint actuator 98 is operably coupled to the phalange joint 80, the first phalange structure 76 and the second phalange structure 78. The phalange joint actuator 98 is configured to adjust or otherwise manipulate the first phalange structure 76 and the second phalange structure 78 about the phalange joint 80. In one non-limiting example illustrated in FIG. 5, the finger structure 74 forms an actuation angle 100 between a portion of the first phalange structure 76 and the second phalange structure 78. More specifically, the actuation angle 100 is defined as the angle formed where the second end 84 of the first phalange structure 76 and the first end 86 of the second phalange structure 78 are operably coupled together by the phalange joint 80. For example, the finger structure 74 is capable of being manipulated or otherwise adjusted between multiple positions. In one non-limiting example, the finger structure 74 is manipulated between a first position 102 (i.e., first radius) and a second position 104 (i.e., second radius). However, other positions are possible. During manipulation of the finger structure 74, the actuation angle 100 formed between the first phalange structure 76 and the second phalange structure 78 can have a range between 180 degrees (i.e., finger structure 74 extended straight) and 100 degrees (i.e., second phalange structure 78 angled down from first phalange structure 76). However, it will be understood that an alternative actuation angle 100 range is possible for manipulating the finger structure 74 between the first position 102 and the second position 104. Furthermore, while the finger structure 74 illustrated in FIGS. 3-5 is configured with the first phalange structure 76, the second phalange structure 78 and the phalange joint 80, other configurations are possible. For example, an alternative configuration of the finger structure 74 includes a plurality of phalange joints 80 and three or more phalange structures (i.e., first phalange structure 76, second phalange structure 78, and a third phalange structure). Such a configuration will add additional manipulation and adjustment capabilities to each finger structure 74 of the surface treatment assembly 60.

Referring back to FIGS. 3 and 4, one non-limiting example of the surface treatment assembly 60 is configured such that the plurality of base structures 70 and finger structures 74 are arranged to form a circular array 72. In some embodiments, the circular array 72 is configured such that each base structure 70 and finger structure 74 circumferentially surround the contoured surface 48 of the fuselage 24. Moreover, each finger structure 74 is adapted to hold and position at least one surface treatment applicator head 106 such as but not limited to, an ink jet print head, a paint nozzle, an abrasion ring, a dry/cure and inspection ring, a heater, an UV emitter, and other known applicator heads. As further illustrated in FIGS. 3 and 4, the surface treatment applicator head 106 is coupled to a second end 108 of the second phalange structure 78 and positioned adjacent to the contoured surface 48 of the fuselage 24. In some embodiments, the surface treatment applicator head 106 is coupled to or otherwise includes an applicator rotatable joint 110, such as but not limited to, a ball joint. The applicator rotatable joint 110 is disposed between the second end 108 of the second phalange structure 78 and the surface treatment applicator head 106. Moreover, the applicator rotatable joint 110 is manipulated or otherwise adjusted along with the base structure rotatable joint 92 and the phalange joint 80 to ensure that each surface treatment applicator head 106 of the surface treatment assembly 60 maintains a normal orientation relative to the contoured surface 48 and a proper distance or dispense gap between the surface treatment applicator head 106 and the contoured surface 48. As a result, the surface treatment assembly 60 is made adjustable about a plurality of axes (i.e., base structure rotatable joint 92, phalange joint 80, and applicator rotatable joint 110) in order to conform with and follow the variety of surface geometries and profiles (i.e., increased/decreased diameter and convex/concave surfaces) encountered along the contoured surface 48 or the fuselage 24, or other component of the vehicle 20 (FIG. 1).

Furthermore, in some embodiments, each surface treatment applicator head 106 and finger structure 74 is interchangeably configured such that the type of surface treatment applicator head 106 attached to the surface treatment assembly 60 depends on the desired surface treatment. For example, the surface treatment applicator head 106 is configured as an ink jet print head used to apply a decorative livery coating on the contoured surface 48, while the surface treatment applicator head 106 is configured as a paint nozzle to apply a primer, adhesion promoter, a base coat, a clear coat layer or other such layer to the contoured surface 48. Alternatively, the surface treatment applicator head 106 attached to each finger structure 74 is configured as an abrasion ring used to clean and abrade the contoured surface 48. In yet another embodiment, the surface treatment applicator head 106 can be configured as a heater and UV emitter to form a dry/cure and inspection ring to dry, cure and inspect the surface treatment layer 51 (FIG. 2) along the contoured surface 48 of the fuselage 24.

In some embodiments, the surface treatment assembly 60 is configured such that the circular array 72 is adjustable with respect to the position of each finger structure 74 relative to the contoured surface 48. For example, each base structure 70 and finger structure 74 is independently adjustable from one another such that the first phalange structure 76 and the second phalange structure 78 of each finger structure is adjusted to maintain the proper positioning (i.e., normal orientation and distance) of each surface treatment applicator head 106 with respect to the contoured surface 48. Moreover, the independent actuation and adjustment of each base structure 70 and finger structure 74 enables a versatile and resilient response by the surface treatment assembly 60 to the complex geometry and contour encountered along the contoured surface 48.

As further shown in FIG. 4, some embodiments of the surface treatment assembly 60 include at least one sensor 112 mounted on or otherwise coupled to each of the finger structures 74. In one non-limiting example the sensor 112 is coupled to or otherwise attached to the second phalange structure 78 near the second end 108. Additionally or alternatively, the sensor 112 is incorporated with the surface treatment applicator head 106. Regardless of its location, the at least one sensor 112 incorporated with each finger structure 74 is configured to scan and collect surface profile and other such data of the contoured surface 48. In some embodiments, the collected data (i.e., contoured data set) is used in to manipulate, adjust or otherwise actuate the surface treatment assembly 60. Furthermore, the sensors 112 such as but not limited to, a vision sensor (i.e., camera), a laser scanning topography and surface height sense sensor (i.e., LIDAR), and other such surface metrology sensors, are configured to scan and monitor the topography and other geometries of the contoured surface 48 and produce a data set of the contoured surface 48. In some embodiments, the data set is used by the surface treatment assembly 60 to adjust and manipulate the base structures 70 and finger structures 74 to ensure that each surface treatment applicator head 106 maintains a normal orientation and distance relative to the contoured surface 48. Moreover, the continuous collection of surface data from the contoured surface 48, and other portions of the fuselage 24, provides improved accuracy in the actuation, manipulation, and adjustment of the surface treatment assembly 60 during the application of the surface treatment layer 51. Additionally, the use of the collected data by the surface treatment assembly 60 reduces the amount of time required to treat the contoured surface 48.

Figure 6:
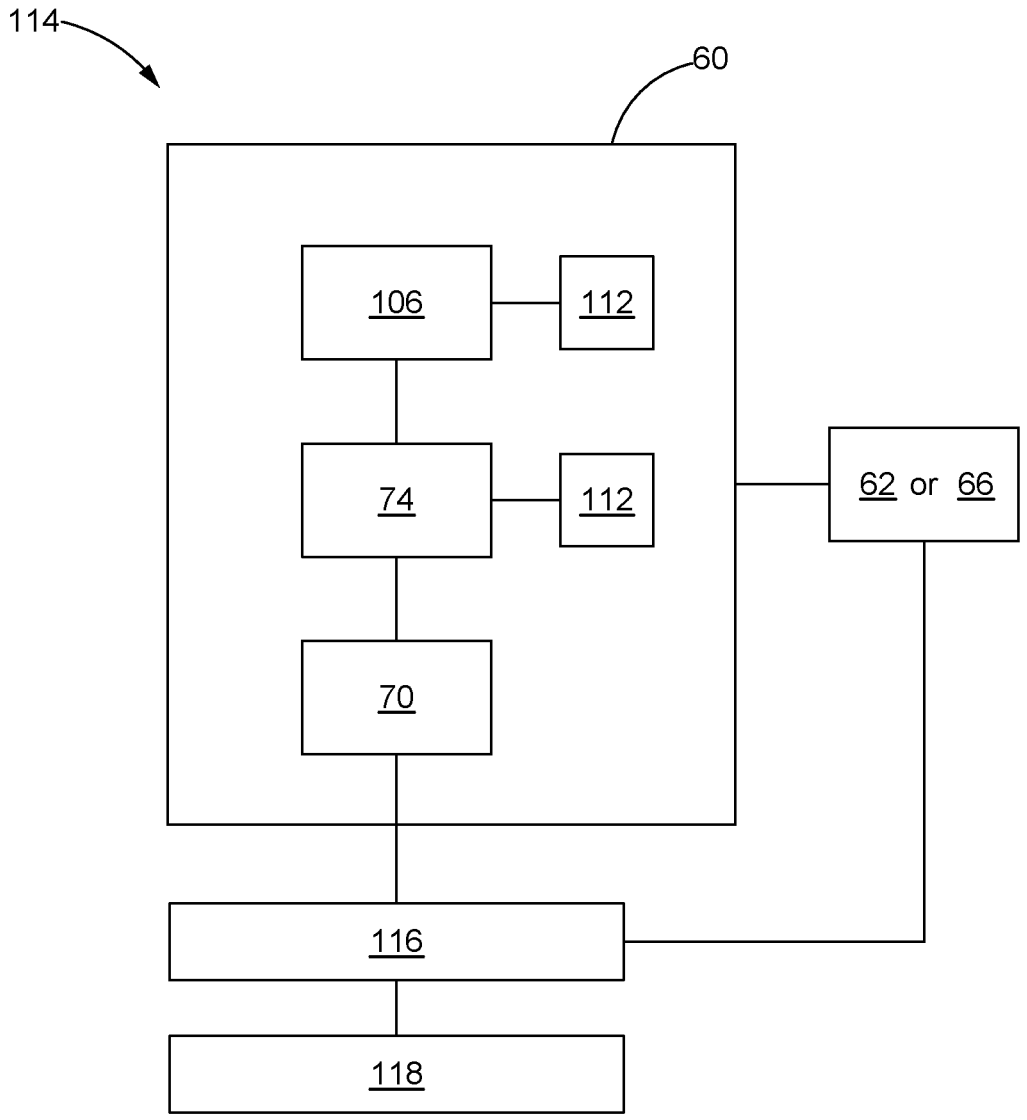
FIG. 6 is a schematic view of an exemplary control and communication system in accordance with the present disclosure.

FIG. 6, with continued reference to FIGS. 2-5, illustrates a schematic of a control and communication system 114 that is configured to operate the overhead gantry 62, and at least one surface treatment assembly 60. The control and communication system 114 is composed of a controller 116 and an input/output terminal 118 which is communicably coupled to the controller 116. Furthermore, in some embodiments, the controller 116 is programmed to control the movement and other operational functions of the overhead gantry 62, and the surface treatment assembly 60. Additionally or alternatively, the surface treatment assembly 60 is attached to one or more AGVs 52 configured to move about the work area 50 (FIG. 2). In such cases, the controller 116 is programmed to control movement of the AGVs 52, the surface treatment assembly 60 and any other such components. Furthermore, the controller 116 is programmed to monitor and adjust the position of each base structure 70, finger structure 74, and surface treatment applicator heads 106. For simplicity, the control and communication system 114 shown in FIG. 6 illustrates a single base structure 70, finger structure 74 and surface treatment applicator head 106. However, it will be understood that the control and communication system 114 is configured to control each of the plurality of base structures 70, finger structures 74, and surface treatment applicator heads 106 included in the surface treatment assembly 60.

In some embodiments, the controller 116 and the input/output terminal 118 are located remotely from the work area 50 (FIG. 2). As a result, communication between the controller 116, the input/output terminal 118, the surface treatment assembly 60 and other components of the control and communications system 114, is established using a radio frequency network, a computer data network, a Wi-Fi data network, a cellular data network, a satellite data network, or any other known data communication network. Alternatively, the controller 116 and the input/output terminal 118 are configured to be proximally located within the work area 50 (FIG. 2) and set up in a position adjacent to the surface treatment assembly 60. In the proximally located configuration, the controller 116 and the input/output terminal 118 are still configured to communicate using a radio frequency network a computer data network, a Wi-Fi data network, a cellular data network, a satellite data network or any other known communication network.

A user of the control and communication system 114, such as an operator, a supervisor, or other interested personnel, can access the controller 116 using the input/output terminal 118. In some embodiments, the input/output terminal 118 allows for commands and other instructions to be input through a keyboard, mouse, dial, button, touch screen, microphone or other known input devices. Furthermore, data and other information generated by the control and communication system 114 and the controller 116 will be output to the input/output terminal 118 through a monitor, touch screen, speaker, printer, or other known output device for the user. In some embodiments, the input/output terminal 118 is communicably coupled to the controller 116 through a wired connection. Alternatively, the input/output terminal 118 is communicably coupled to the controller 116 through a wireless communication network such as Bluetooth, near-field communication, a radio frequency network, a computer data network, a Wi-Fi data network, a cellular data network, a satellite data network or any other known data communication network. In some embodiments, the input/output terminal 118 is a handheld mobile device, such as a tablet computer, a smart phone device, or other such mobile device, and the handheld mobile device is wirelessly coupled to the controller 116. As a result, one or more users of the control and communication system 114 can access the controller 116, each user having a different handheld input/output terminal 118 that is remotely located from the controller 116 and/or the surface treatment assembly 60. Such a configuration will allow for the flexibility in monitoring and operating the control and communication system 114 during treatment of the contoured surface 48 of the fuselage 24.

In some embodiments, the controller 116 of the control and communication system 114 is composed of one or more computing devices that are capable of executing a control mechanism and/or software which allows the user to direct and control the surface treatment assembly 60. The one or more computing devices of the controller 116 are programmed to control the movement of the overhead gantry 62, the surface treatment AGV 52, or other movement device, to move and position the at least one surface treatment assembly 60 along the contoured surface 48 of the fuselage 24. Furthermore, the one or more computing devices of the controller 116 are programmed to control the actuation and adjustment of the surface treatment assembly 60 in order to properly position the surface treatment assembly 60 relative to the contoured surface 48. In one exemplary application of the control and communication system 114, the user is able to use the controller 116 and input/output terminal 118 to program a pattern or process for the surface treatment assembly 60 to follow while applying the surface treatment layer 51 or other such treatment along the contoured surface 48. Furthermore, the communicably coupling of the controller 116, the input/output terminal 118, and the surface treatment assembly 60 using a communication network allows for two-way communication such that commands sent by the controller 116 are received by the surface treatment assembly 60, and data collected by the surface treatment assembly 60 is sent to and received by the controller 116.

In an embodiment, at least one sensor 112 such as but not limited to, a vision sensor (i.e., camera), a laser scanning topography and surface height sense sensor (i.e., LIDAR), and other such surface metrology sensor, is incorporated into the surface treatment assembly 60 and communicably coupled to the controller 116 and the input/output terminal 118. In some embodiments, each finger structure 74 of the surface treatment assembly 60 includes the sensor 112 configured to scan and monitor the surface topography and other geometries of the contoured surface 48. Additionally or alternatively, each surface treatment applicator head 106 is configured to include the sensor 112. The data collected by the sensors 112 is transmitted to and utilized by the controller 116. Furthermore, the controller 116 is programmed to store, analyze and extract information from the data collected by the plurality of sensors 112 and use the extracted information to control and adjust the surface treatment assembly 60. Furthermore, an embodiment of the control and communication system 114 is configured to use the extracted information to independently control and adjust each base structure 70, finger structure 74, and surface treatment applicator head 106 of the surface treatment assembly 60.

Furthermore, the at least one sensor 112 and the controller 116 are operably coupled which enables them to work together to collect data on the contoured surface 48 such as but not limited to, detect a change in the radius (i.e., increase or decrease) of the fuselage 24, collect imaging and vision data of the contoured surface 48, provide a topographical map and surface profile of the contoured surface 48, provide positioning and location data of the surface treatment assembly 60, and provide any other such surface data collected by the at least one sensor 112. The collected data is then transmitted by the at least one sensor 112 and received by the controller 116 such that the control mechanism and/or software of the controller 116 is able to utilize the data to make adjustments to the control and operation of the overhead gantry 62, the surface treatment assembly 60, individual base structures 70, finger structures, surface treatment applicator heads 106, and other such components. Additionally, the user is able to view the data collected by the at least one sensor 112 on the input/output terminal 118, and if necessary, make adjustments to the control commands sent from the controller 116 to the overhead gantry 62, the surface treatment assembly 60, individual base structures 70, finger structures 74, surface treatment applicator heads 106, and other such components. In some embodiments, the control and communication system 114 is capable of making real time adjustments to the overhead gantry 62, the surface treatment assembly 60, individual base structures 70, finger structures 74, surface treatment applicator heads 106 and other such components through the two-way communication link established between the surface treatment assembly 60 and the control and communication system 114.

Figure 7:
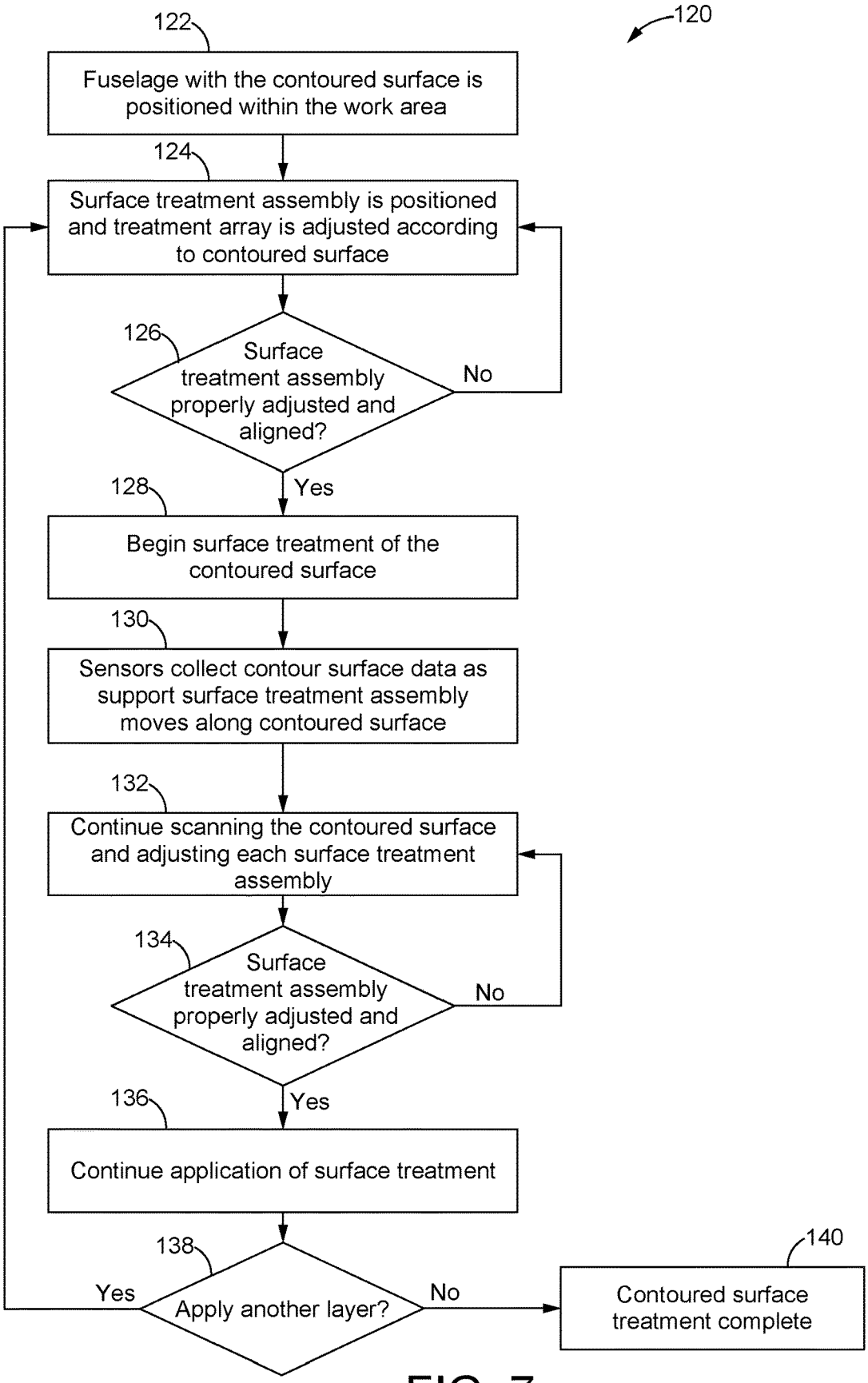
FIG. 7 is a flowchart illustrating an exemplary method of treating a contoured surface with the surface treatment assembly in accordance with the present disclosure.

Referring now to FIG. 7 and with continued reference to the proceeding FIGS. 1-6, a flowchart illustrating an exemplary surface treatment method or process 120 of treating a contoured surface 48 with a surface treatment assembly 60 is illustrated. In a first block 122 of the method 120 of treating the contoured surface 48 with a surface treatment assembly 60, a structure having a contoured surface 48, such as the fuselage 24, is moved into position for surface treatment within the work area 50. In one non-limiting example the fuselage 24 is transported into the work area 50 by one or more AGVs 52 and delivered to the vehicle nose support structure 54, the vehicle central support structure 56, or other support structures. During surface treatment, the fuselage 24 is supported by the nose and vehicle central support structures 54, 56, the one or more AGVs 52 and any other support structures that may be needed.

In one non-limiting example, the application of the surface treatment layer 51 includes the removal of any protective or previously applied coatings on the contoured surface 48, masking certain areas of the contoured surface 48 not to be treated, abrading, cleaning, and drying the contoured surface 48, applying a surface protective coating, an adhesion promoting coating, a primer coating, a basecoat coating, a sol-gel coating, a top layer coating, a decorative livery coating, a clear coating, and/or other protective coatings and/or preparation treatments. Furthermore, prior to the start of the treatment of the contoured surface 48, in a next block 124 at least one surface treatment assembly 60 is attached or otherwise coupled to the overhead gantry 62 and positioned within the work area 50. Moreover, the surface treatment assembly 60 adjusted and aligned along the contoured surface 48 of the fuselage 24. In some embodiments, during the adjustment and alignment of the surface treatment assembly 60, at least one sensor 112 attached to the surface treatment assembly 60 is configured to scan and collect the surface topography data of the contoured surface 48. The surface topography data or contoured data set is then transmitted to and received by the controller 116 of the control and communication system 114 and utilized to adjust the command and control parameters sent from the controller 116 to the surface treatment assembly 60.

According to a next block 126, an adjustment check is performed prior to the application of the surface treatment layer 51 along the contoured surface 48 to confirm that each base structure, 70, finger structure 74, and surface treatment applicator head 106 of the surface treatment assembly 60 are properly adjusted and aligned relative to the contoured surface 48. In some embodiments, the adjustment check includes confirmation of the proper distance or gap between the contoured surface 48 and each surface treatment applicator head 106. Additionally the adjustment check confirms that each surface treatment applicator head 106 is in a normal and orthogonal orientation relative to the contoured surface 48. Failure to properly adjust and align each surface treatment applicator head 106 of the surface treatment assembly 60 relative to the contoured surface 48 will result in a defective surface treatment such as, a non-uniform application of the surface treatment layer 51, or other such surface treatment defect. Therefore, if the inspection fails the set of pre-determined adjustment criteria which are input into and stored in the controller 116, then the surface treatment assembly 60 continues adjustment of the surface treatment assembly 60 to correct any adjustment and/or alignment errors. In some embodiments, the operator or other user will be notified of the adjustment errors and instructed to make the necessary adjustment and alignment of the surface treatment assembly 60.

Once the surface treatment assembly 60 is properly adjusted and aligned, then in a next block 128 the surface treatment assembly 60 begins the desired treatment of the contoured surface 48. In some embodiments, each of the finger structures 74 of the surface treatment assembly 60 are interchangeably coupled to at least one surface treatment applicator head 106 such as but not limited to, an abrasion ring, a paint nozzle, an ink jet print head, a dry/cure and inspection ring, a heater, an UV emitter, and other known applicator heads. The surface treatment applicator head 106 is chosen based on the desired surface treatment of the contoured surface 48. Moreover, the surface treatment assembly 60 generally starts the application of the surface treatment layer 51 on the contoured surface 48 at the tail section 28 of the vehicle 20 and moves along the fuselage 24 towards the nose portion 46. Alternatively, the surface treatment assembly 60 is aligned and adjusted at an intermediate location between the tail section 28 and the nose portion 46 and the surface treatment assembly 60 applies the surface treatment layer 51 along the contoured surface 48 where directed.

In a next block 130, the surface treatment assembly 60 continues moving along the contoured surface 48, and at least one sensor 112 continues to scan and collect data of the contoured surface 48 topography. In some embodiments, the data collected by the sensor 112 is utilized by the controller 116 to make real-time adjustments to the surface treatment assembly 60 as it moves along the contoured surface 48. For example, each base structure 70, finger structure 74, and surface treatment applicator head 106 of the surface treatment assembly 60 is continuously adjusted to maintain a normal and orthogonal orientation between the surface treatment applicator head 106 and the contoured surface 48. Furthermore, the controller 116 continues to analyze the surface topography data collected by the at least one sensor 112 as the surface treatment assembly 60 continues to move along the contoured surface 48 of the fuselage 24.

As a result, in a next block 132 the control and communication system 114, which includes the controller 116, will continuously perform adjustment checks to confirm that each base structure 70, finger structure 74 and surface treatment applicator head 106 of the surface treatment assembly 60 is properly adjusted, aligned, and orientated with the contoured surface 48. In some embodiments, if one or more of the base structures 70, finger structures 74, and surface treatment applicator heads 106 are out of adjustment, alignment, and/or orientation, then the controller 116 will transmit an adjustment control signal to the surface treatment assembly 60 to adjust or readjust each base structure 70, finger structure 74, and surface treatment applicator head 106 of the surface treatment assembly 60. In a next block 134, if it is determined that one or more base structure 70, finger structure 74, and/or surface treatment applicator head 106 remains out of alignment, then the surface treatment assembly 60 stops moving along the contoured surface 48 of the fuselage 24 in order to perform the readjustment. In some embodiments, the method 120 of treating the contoured surface 48 returns to block 132 for readjustment of each base structure 70, finger structure 74 and surface treatment applicator head 106 of the surface treatment assembly 60 In an alternative embodiment, the surface treatment assembly 60 moves along the contoured surface 48 at a slower pace in order to perform the readjustment and realignment of each base structure 70, finger structure 74 and surface treatment applicator head 106 on the fly.

Provided the surface treatment assembly 60 passes the continuous adjustment, alignment, and orientation checks, then in a next block 136 the surface treatment assembly 60 will continue moving along the contoured surface 48. In a next block 138, when the surface treatment assembly 60 reaches the nose portion 46, or other pre-determined stopping point along the fuselage 24, the controller 116 makes a determination of whether another surface treatment is required. If another treatment is required, then in one non-limiting example, the method 120 of treating a contoured surface 48 returns to block 124 and the appropriate surface treatment applicator head 106 is coupled to each finger structure 74, and the surface treatment assembly 60 is positioned at the designated starting position (i.e., the nose portion 46, the tail section 28 or alternative pre-determined starting point) and prepares for the next surface treatment along the contoured surface 48 of the fuselage 24. In some embodiments, the same surface treatment assembly 60 is used for the subsequent surface treatment and the surface treatment applicator heads 106 are exchanged depending on the desired surface treatment. Alternatively, subsequent surface treatments are performed to the contoured surface 48 using one or more additional surface treatment assemblies 60 configured with the desired surface treatment applicator heads 106. Once all of the desired surface treatments have been performed to the contoured surface 48, then in a next block 140 the surface treatment method 120 is concluded and the fuselage 24 is moved on to the next manufacturing or service step.

While the foregoing detailed description has been given and provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims appended hereto. Moreover, while some features are described in conjunction with certain specific embodiments, these features are not limited to use with only the embodiment with which they are described, but instead may be used together with or separate from, other features disclosed in conjunction with alternate embodiments.

What is claimed is:

1. A method of treating a contoured surface with a surface treatment assembly, the method comprising:

forming a surface treatment array from a plurality of base structures;

coupling a finger structure to each base structure of the plurality of base structures, the finger structure including a first phalange structure, a second phalange structure and a phalange joint disposed therebetween;

coupling at least one applicator head to the second phalange structure of each finger structure, each of the at least one applicator head configured to apply a surface treatment layer to the contoured surface; and coupling a base structure actuator to each base structure and a phalange joint actuator to each phalange joint, and manipulating each of the base structure actuators and each of the phalange joint actuators such that the surface treatment array is adjusted relative to the contoured surface.

2. The method of claim 1, wherein forming the surface treatment array includes arranging the plurality of base structures in a circular array configured to surround and treat the contoured surface along a tubular structure.

3. The method of claim 1, wherein manipulating the base structure actuator and the phalange joint actuator includes coordinating activation of the base structure actuator and the phalange joint actuator and adjusting each finger structure of the surface treatment array between a first contoured shape and a second contoured shape.

4. The method of claim 3, wherein adjusting the surface treatment array between the first contoured shape and the second contoured shape includes adjusting the surface treatment array between a first radius and a second radius.

5. The method of claim 1, wherein coupling the finger structure to each base structure of the plurality of base structure comprises forming a slot in each base structure and pivotally coupling a ball joint to the first phalange structure such that manipulating the base structure actuator causes the first phalange structure to pivot about the ball joint within the slot.

6. The method of claim 1, further comprising at least one sensor coupled to each finger structure and manipulating each finger structure includes the at least one sensor detecting an existing shape of the contoured surface and generating a contoured data set.

7. The method of claim 6, further comprising a controller communicably coupled to the at least one sensor, the base structure actuator, and the phalange joint actuator, and adjusting the surface treatment array comprises programming the controller to receive a signal from the at least one sensor and controlling each of the base structure actuators and the phalange joint actuators to manipulate the surface treatment array based on the contoured data set.

8. The method of claim 1, wherein coupling the at least one applicator head to each finger structure includes pivotally coupling the second phalange joint to a finger ball joint, and the at least one applicator head comprises one of a spray nozzle, and an ink jet printing head configured to pivot about the finger ball joint and apply a surface treatment to the contoured surface.

9. A method of treating a contoured surface with a surface treatment assembly, the method comprising:

forming a circular surface treatment array from a plurality of base structures;

coupling a finger structure to each base structure of the plurality of base structures, the finger structure including a first phalange structure, a second phalange structure and a phalange joint disposed therebetween;

coupling at least one applicator head to the second phalange structure of each finger structure, each of the at least one applicator head configured to apply a surface treatment layer to the contoured surface; and coupling a base structure actuator to each base structure configured to manipulate the first phalange structure of each finger structure;

coupling a phalange joint actuator to each phalange joint configured to manipulate the second phalange structure of each finger structure; and manipulating each of the base structure actuators and each of the phalange joint actuators such that the circular surface treatment array is adjusted relative to the contoured surface.

10. The method of claim 9, wherein manipulating the base structure actuator and the phalange joint actuator includes coordinating activation of the base structure actuator and the phalange joint actuator and adjusting each finger structure of the circular surface treatment array between a first contoured shape and a second contoured shape.

11. The method of claim 10, wherein adjusting the circular surface treatment array between the first contoured shape and the second contoured shape includes adjusting the circular surface treatment array between a first radius and a second radius.

12. The method of claim 9, wherein coupling the finger structure to each base structure of the plurality of base structure comprises forming a slot in each base structure and pivotally coupling a ball joint to the first phalange structure such that manipulating the base structure actuator causes the first phalange structure to pivot about the ball joint within the slot.

13. The method of claim 9, further comprising at least one sensor coupled to each finger structure and manipulating each of the base structure actuators and each of the phalange joint actuators includes the at least one sensor detecting an existing shape of the contoured surface and generating a contoured data set.

14. The method of claim 13, further comprising a controller communicably coupled to the at least one sensor, the base structure actuator, and the phalange joint actuator, and adjusting the circular surface treatment array comprises programming the controller to receive a signal from the at least one sensor and controlling each of the base structure actuators and the phalange joint actuators to manipulate the circular surface treatment array based on the contoured data set.

15. The method of claim 9, wherein coupling the at least one applicator head to each finger structure includes pivotally coupling the second phalange joint to a finger ball joint, and the at least one applicator head comprises one of a spray nozzle, and an ink jet printing head configured to pivot about the finger ball joint and apply a surface treatment to the contoured surface.

16. A method of treating an exterior surface of an airplane with a surface treatment assembly, the method comprising:

forming a surface treatment array from a plurality of base structures;

coupling a finger structure to each base structure of the plurality of base structures, the finger structure including a first phalange structure, a second phalange structure and a phalange joint disposed therebetween;

coupling at least one applicator head to the second phalange structure of each finger structure, each of the at least one applicator head configured to apply a surface treatment layer to the exterior surface of the airplane;

coupling a base structure actuator to each base structure configured to manipulate the first phalange structure of each finger structure;

coupling a phalange joint actuator to each phalange joint configured to manipulate the second phalange structure of each finger structure;

coupling at least one sensor to each finger structure, the at least one sensor configured to detect an existing shape of the exterior surface of the airplane and generate a contoured data set; and manipulating each of the base structure actuators and each of the phalange joint actuators based on the contoured data set from the at least one sensor to adjust the surface treatment array relative to the exterior surface of the airplane.

17. The method of claim 16, wherein manipulating the base structure actuator and the phalange joint actuator includes coordinating activation of the base structure actuator and the phalange joint actuator and adjusting each finger structure of the surface treatment array between a first contoured shape and a second contoured shape.

18. The method of claim 17, wherein adjusting the surface treatment array between the first contoured shape and the second contoured shape includes adjusting the surface treatment array between a first radius and a second radius.

19. The method of claim 16, further comprising a controller communicably coupled to the at least one sensor, the base structure actuator, and the phalange joint actuator, and adjusting the surface treatment array comprises programming the controller to receive the contour data set from the at least one sensor and controlling each of the base structure actuators and the phalange joint actuators to manipulate the surface treatment array based on the contoured data set.

20. The method of claim 16, wherein coupling the at least one applicator head to each finger structure includes pivotally coupling the second phalange joint to a finger ball joint, and the at least one applicator head comprises one of a spray nozzle, and an ink jet printing head configured to pivot about the finger ball joint and apply a surface treatment to the exterior surface of the airplane.

* * * * *